US006398088B1

(12) United States Patent
Burke

(10) Patent No.: US 6,398,088 B1
(45) Date of Patent: Jun. 4, 2002

(54) BABY HOLDING AND FEEDING APPARATUS

(76) Inventor: Diane Burke, 729 W. Huntingdon St., Philadelphia, PA (US) 19133

( * ) Notice: Subject to any disclaimer, the term of this patent is extended or adjusted under 35 U.S.C. 154(b) by 0 days.

(21) Appl. No.: 09/805,002

(22) Filed: Mar. 12, 2001

(51) Int. Cl.[7] ..... A61G 1/00

(52) U.S. Cl. ..... 224/160; 224/148.6; 224/161; D3/214

(58) Field of Search ..... 224/159, 160, 224/161, 148.6; D3/213, 214

(56) References Cited

U.S. PATENT DOCUMENTS

| | | | | | |
|---|---|---|---|---|---|
| 484,065 | A | * | 10/1892 | Taylor | 224/160 |
| 3,144,230 | A | * | 8/1964 | Brooks | 224/148.6 |
| 4,220,302 | A | * | 9/1980 | Hampton et al. | 224/148.6 |
| 4,986,458 | A | * | 1/1991 | Linday | 224/160 |
| 5,178,309 | A | * | 1/1993 | Bicheler et al. | 224/153 |
| 5,246,152 | A | * | 9/1993 | Dotseth | 224/158 |
| D357,800 | S | * | 5/1995 | Roan et al. | D3/213 |
| 5,522,528 | A | * | 6/1996 | Petricola | 224/160 |
| 5,813,580 | A | * | 9/1998 | Fair | 224/160 |
| 5,927,576 | A | * | 7/1999 | Nielsen | 224/160 |
| 6,045,018 | A | * | 4/2000 | Onishi | 224/158 |

* cited by examiner

*Primary Examiner*—Stephen K. Cronin
(74) *Attorney, Agent, or Firm*—Goldstein Law Offices, P.C.

(57) ABSTRACT

A baby holding and feeding apparatus including a body harness adapted for being worn about a torso of a user. A semi-rigid cradle portion is secured to the front ends of the shoulder straps of the body harness. The cradle portion is adapted for holding a baby therein. The cradle portion is comprised of a back panel and a front panel. The back panel is generally arcuate for supporting the baby thereon. A bottle holding portion is secured to an outer edge of the back panel of the cradle portion. The bottle holding portion is adapted for holding a bottle therein whereby a nipple of the bottle may be directed into a mouth of the baby positioned within the cradle portion.

6 Claims, 1 Drawing Sheet

16
10
30
14
44
40
20

24
28
24
42
46
36
32
34
38
26
12
18
22

BABY HOLDING AND FEEDING APPARATUS

BACKGROUND OF THE INVENTION

The present invention relates to a baby holding and feeding apparatus and more particularly pertains to holding a baby and a bottle for the baby to feed from while allowing a mother to keep her hands free.

Most mothers and care-givers are often faced with multiple tasks during a day, especially when babies are involved. One of the more time-consuming tasks involves the feeding of the baby. The mother or care-giver typically is required to prepare a bottle and then sit in a chair to feed the bottle to the baby as it is cradled in her arms. Many of these women are juggling too many tasks to afford them the time to sit for an extended period to properly feed their baby's. What is needed is a device that will allow a care-giver to feed a baby while they remain able to perform other tasks.

The present invention attempts to solve the abovementioned problem by providing a device that allows a care-giver to support a baby while keeping their hands free and support a bottle for the baby from which to feed.

The use of infant care support devices is known in the prior art. More specifically, infant care support devices heretofore devised and utilized for providing care to infants' and baby's are known to consist basically of familiar, expected and obvious structural configurations, notwithstanding the myriad of designs encompassed by the crowded prior art that have been developed for the fulfillment of countless objectives and requirements.

By way of example, U.S. Pat. No. 3,850,393 to Marquard discloses a baby bottle holder comprising a clamp assembly suspended from the neck of the guardian. U.S. Pat. No. 5,573,153 to Stillman discloses a feeding device comprising a cloth capable of being draped over the shoulder and includes hook and loop fasteners for securing a baby bottle. U.S. Pat. No. 5,707,031 to Creighton-Young discloses a forearm support for holding a baby while feeding.

While these devices fulfill their respective, particular objective and requirements, the aforementioned patents do not describe a baby holding and feeding apparatus for holding a baby and a bottle for the baby to feed from while allowing a mother to keep her hands free.

In this respect, the baby holding and feeding apparatus according to the present invention substantially departs from the conventional concepts and designs of the prior art, and in doing so provides an apparatus primarily developed for the purpose of holding a baby and a bottle for the baby to feed from while allowing a mother to keep her hands free.

Therefore, it can be appreciated that there exists a continuing need for a new and improved baby holding and feeding apparatus that can be used for holding a baby and a bottle for the baby to feed from while allowing a mother to keep her hands free. In this regard, the present invention substantially fulfills this need.

SUMMARY OF THE INVENTION

In the view of the foregoing disadvantages inherent in the known types of infant care support devices now present in the prior art, the present invention provides an improved baby holding and feeding apparatus. As such, the general purpose of the present invention, which will be described subsequently in greater detail, is to provide a new and improved baby holding and feeding apparatus that has all the advantages of the prior art and none of the disadvantages.

To attain this, the present invention essentially comprises a body harness adapted for being worn about a torso of a user. The body harness includes a belt portion adapted for wrapping around a waist of the user. The belt portion includes an openable buckle on a front segment thereof to facilitate donning. The body harness includes a pair of semi-rigid shoulder straps. The shoulder straps each have back ends secured to a rear segment of the belt portion. The shoulder straps each have front ends ending at a position above the openable buckle on the front segment. A semi-rigid cradle portion is secured to the front ends of the shoulder straps of the body harness. The cradle portion is adapted for holding a baby therein. The cradle portion comprises a back panel and a front panel. The back panel is generally arcuate for supporting the baby thereon. The front panel includes an elastic belt for containing the baby within the cradle portion. The front panel has a pair of apertures' therethrough to allow the baby's legs to extend therethrough. A bottle holding portion is secured to an outer edge of the back panel of the cradle portion. The bottle holding portion is adapted for holding a bottle therein whereby a nipple of the bottle may be directed into a mouth of the baby positioned within the cradle portion. The bottle holding portion comprises an adjustable band having opposed ends secured to the back panel forming a loop. The loop has an opening for receiving the bottle therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved baby holding and feeding apparatus that has all the advantages of the prior art infant care support devices and none of the disadvantages.

It is another object of the present invention to provide a new and improved baby holding and feeding apparatus that may be easily and efficiently manufactured and marketed.

It is a further object of the present invention to provide a new and improved baby holding and feeding apparatus that is of durable and reliable construction.

An even further object of the present invention is to provide a new and improved baby holding and feeding apparatus that is susceptible of a low cost of manufacture with regard to both materials and labor, and which accordingly is then susceptible of low prices of sale to the consuming public, thereby making such a baby holding and feeding apparatus economically available to the buying public.

Even still another object of the present invention is to provide a new and improved baby holding and feeding apparatus for holding a baby and a bottle for the baby to feed from while allowing a mother to keep her hands free.

Lastly, it is an object of the present invention to provide a new and improved baby holding and feeding apparatus including a body harness adapted for being worn about a torso of a user. A semi-rigid cradle portion is secured to the front ends of the shoulder straps of the body harness. The cradle portion is adapted for holding a baby therein. The cradle portion comprises a back panel and a front panel. The back panel is generally arcuate for supporting the baby thereon. A bottle holding portion is secured to an outer edge of the back panel of the cradle portion. The bottle holding portion is adapted for holding a bottle therein whereby a nipple of the bottle may be directed into a mouth of the baby positioned within the cradle portion.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
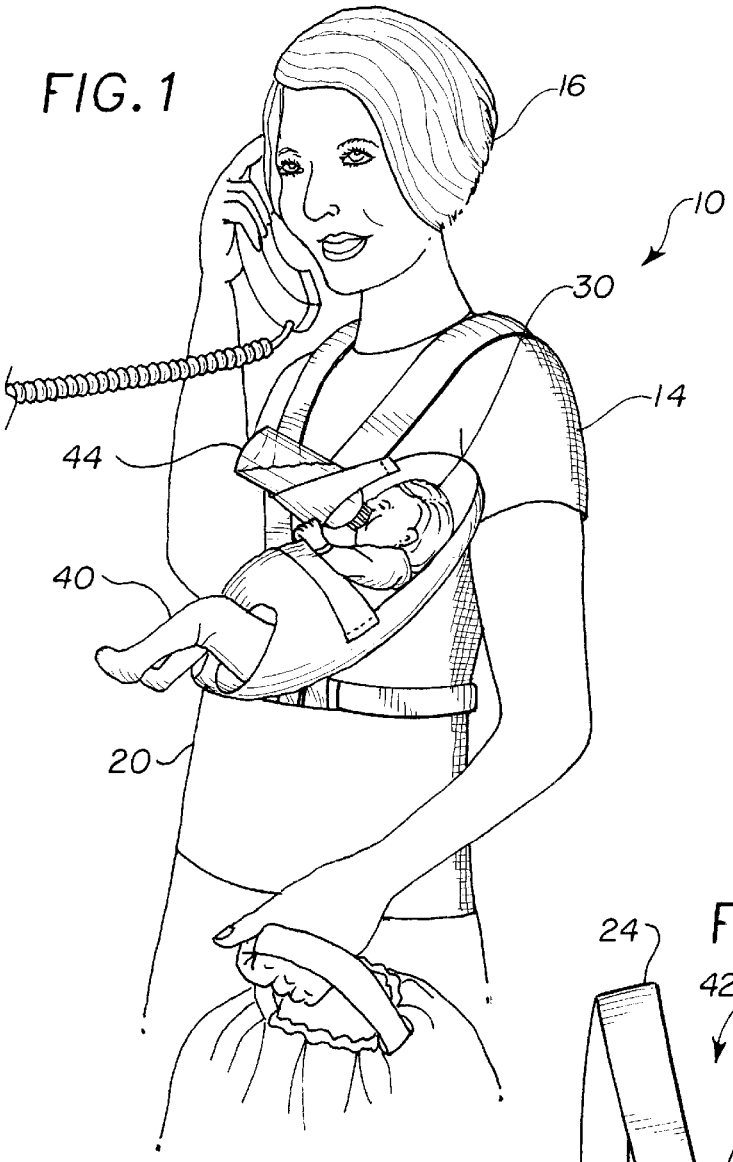
FIG. 1 is a perspective view of the preferred embodiment of the baby holding and feeding apparatus constructed in accordance with the principles of the present invention illustrated in use.
Figure 2:
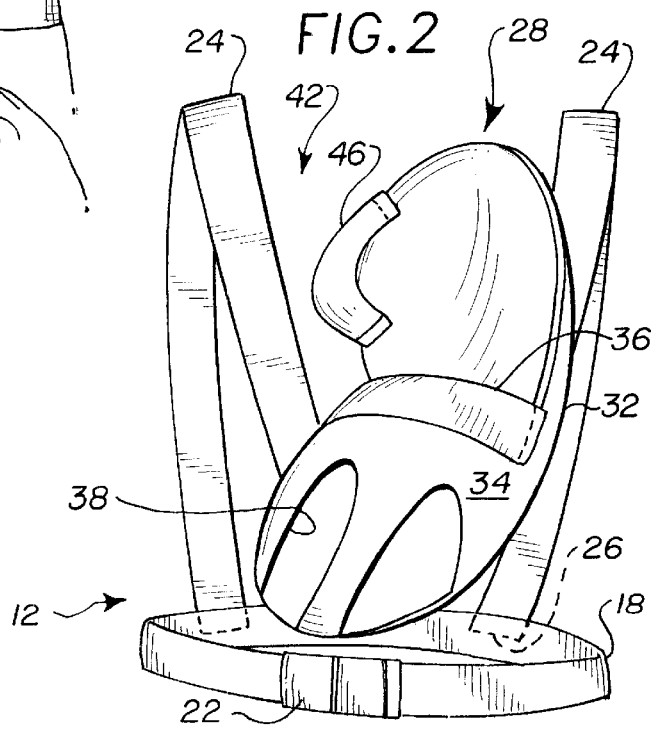
FIG. 2 is a perspective view of the present invention.

With reference now to the drawings, and in particular, to FIGS. 1 through two thereof, the preferred embodiment of the new and improved baby holding and feeding apparatus embodying the principles and concepts of the present invention and generally designated by the reference number 10 will be described.

Specifically, it will be noted in the various Figures that the device relates to a baby holding and feeding apparatus for holding a baby and a bottle for the baby to feed from while allowing a mother to keep her hands free. In its broadest context, the device consists of a body harness, a semi-rigid cradle portion, and a bottle holding portion. Such components are individually configured and correlated with respect to each other so as to attain the desired objective.

The body harness 12 is adapted for being worn about a torso 14 of a user 16. Note FIG. 1. The body harness 12 includes a belt portion 18 adapted for wrapping around a waist 20 of the, user 16. The belt portion 18 includes an openable buckle 22 on a front segment thereof to facilitate donning. The body harness 12 includes a pair of semi-rigid shoulder straps 24. The shoulder straps 24 each have back ends 26 secured to a rear segment of the belt portion 18. The shoulder straps 24 each have front ends ending at a position above the openable buckle 22 on the front segment. When in use, the shoulder straps 24 will be disposed over the shoulders of the user 16.

The semi-rigid cradle portion 28 is secured to the front ends of the shoulder straps 24 of the body harness 12. The cradle portion 28 is adapted for holding a baby 30 therein. The cradle portion 28 comprises a back panel 32 and a front panel 34. The back panel 32 is generally arcuate for supporting the baby 30 thereon. The front panel 34 includes an elastic belt 36 for containing the baby 30 within the cradle portion 28. The front panel 34 has a pair of apertures 38 therethrough to allow the baby's legs 40 to extend therethrough. The cradle portion 28 is positioned at an angle to properly position the baby 30 for correct feeding. The positioning of the cradle portion 28 will essentially replicate the position of the baby 30 being cradled in the user's arms.

The bottle holding portion 42 is secured to an outer edge of the back panel 32 of the cradle portion 28. The bottle holding portion 42 is adapted for holding a bottle 44 therein whereby a nipple of the bottle 44 may be directed into a mouth of the baby 30 positioned within the cradle portion 28. Note FIG. 1. The bottle holding portion 42 comprises an adjustable band 46 having opposed ends secured to the back panel 32 forming a loop. The loop has an opening for receiving the bottle 44 therein. The adjustable band 46 can be maneuvered so that the bottle 44 is properly positioned for the baby 30 from which to feed.

The present invention can help a busy mother or caregiver get more accomplished, and eliminate stress by freeing her hands when the baby is hungry. The present invention will also decrease medical problems due to an improper feeding angle, and will allow bonding between mother and baby.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A baby holding and feeding apparatus for holding a baby and a bottle for the baby to feed from while allowing a mother to keep her hands free comprising, in combination:

a body harness adapted for being worn about a torso of a user;

a semi-rigid cradle portion secured to the body harness, the cradle portion being adapted for holding a baby therein, the cradle portion being comprised of a back panel and a front panel, the back panel being generally arcuate for supporting the baby thereon; and a bottle holding portion secured to an outer edge of the back panel of the cradle portion, the bottle holding portion being adapted for holding a bottle therein whereby a nipple of the bottle may be directed into a mouth of the baby positioned within the cradle portion.

2. The baby holding and feeding apparatus as set forth in claim 1, wherein the body harness includes a belt portion adapted for wrapping around a waist of the user, the belt portion including an openable buckle on a front segment thereof to facilitate donning, the body harness including a pair of semi-rigid shoulder straps, the shoulder straps each having back ends secured to a rear segment of the belt portion, the shoulder straps each having front ends ending at a position above the openable buckle on the front segment for being secured to the cradle portion.

3. The baby holding and feeding apparatus as set forth in claim 1 wherein the bottle holding portion is comprised of an adjustable band having opposed ends secured to the back panel forming a loop, the loop having an opening for receiving the bottle therein.

4. The baby holding and feeding apparatus as set forth in claim 1, wherein the front panel of the cradle portion includes an elastic belt for containing the baby within the cradle portion.

5. The baby holding and feeding apparatus as set forth in claim 4, wherein the front panel of the cradle portion has a pair of apertures' therethrough to allow the baby's legs to extend therethrough.

6. A baby holding and feeding apparatus for holding a baby and a bottle for the baby to feed from while allowing a mother to keep her hands free comprising, in combination:

a body harness adapted for being worn about a torso of a user, the body harness including a belt portion adapted for wrapping around a waist of the user, the belt portion including an openable buckle on a front segment thereof to facilitate donning, the body harness including a pair of semi-rigid shoulder straps, the shoulder straps each having back ends secured to a rear segment of the belt portion, the shoulder straps each having front ends ending at a position above the openable buckle on the front segment;

a semi-rigid cradle portion secured to the front ends of the shoulder straps of the body harness, the cradle portion being adapted for holding a baby therein, the cradle portion being comprised of a back panel and a front panel, the back panel being generally arcuate for supporting the baby thereon, the front panel including an elastic belt for containing the baby within the cradle portion, the front panel having a pair of apertures' therethrough to allow the baby's legs to extend therethrough; and a bottle holding portion secured to an outer edge of the back panel of the cradle portion, the bottle holding portion being adapted for holding a bottle therein whereby a nipple of the bottle may be directed into a mouth of the baby positioned within the cradle portion, the bottle holding portion being comprised of an adjustable band having opposed ends secured to the back panel forming a loop, the loop having an opening for receiving the bottle therein.

* * * * *